US011802553B1

(12) United States Patent
Wu

(10) Patent No.: US 11,802,553 B1
(45) Date of Patent: Oct. 31, 2023

(54) PORTABLE AIR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 0 days.

(21) Appl. No.: 17/885,772

(22) Filed: Aug. 11, 2022

(51) Int. Cl.
*F04B 33/00* (2006.01)
*F04B 39/14* (2006.01)
*F04B 39/10* (2006.01)

(52) U.S. Cl.
CPC ..... *F04B 33/005* (2013.01); *F04B 39/1013* (2013.01); *F04B 39/14* (2013.01)

(58) Field of Classification Search
CPC .... F04B 33/005; F04B 39/1013; F04B 39/14; F04B 53/10; F04B 33/00; F16K 15/20; F16K 31/52416
USPC ..... 417/234, 374, 544, 437, 454; 137/223, 137/231, 224, 224.5, 225, 226, 227, 228, 137/229, 230, 232, 233, 234, 234.5, 270, 137/271
See application file for complete search history.

(56) References Cited

FOREIGN PATENT DOCUMENTS

TW M478743 U 5/2014

*Primary Examiner* — Kenneth J Hansen
*Assistant Examiner* — Benjamin Doyle

(57) ABSTRACT

A portable air pump includes an inflating unit and a connection unit. The inflating unit includes a cylinder and a joint portion. The connection unit includes a body, a valve connecting assembly, and a valve seat. The body has an axial hole and a joint hole communicating with the axial hole. The valve connecting assembly is arranged through the axial hole and includes a first connecting hole for connecting a Schrader valve, a second connecting hole for connecting a Presta valve, and a through hole communicating with the axial hole. The valve seat is movably arranged in the through hole for abutting the Schrader valve or the Presta valve. The joint hole, and one of the first and second connecting holes are detachably connected to the joint portion.

10 Claims, 8 Drawing Sheets

PORTABLE AIR PUMP

BACKGROUND

The present invention relates to a air pump and, more particular, to a portable air pump which can attach to either one of a Schrader valve and a Presta valve.

A traditional air pump for Schrader and Presta valves, as disclosed in FIGS. 9 to 11 of Taiwan Patent No. TWM478743, includes a head, a plug body, a center head, a nozzle plug, a cover, and a trigger member. When the user needs to inflate another type valve, the user must screw out the cover, take out the center head and nozzle plug from the head, turn the center head and the nozzle plug over and put them back into the head in sequence, finally screws the cover to the head to complete the transform for inflating.

However, the user is hard to identify whether the assembly direction of the center head and the nozzle plug is correct, it is not only easy to assemble wrongly but also easy to lose the center head and the nozzle plug when they are taken out from the head.

Further, the traditional air pump uses the trigger member to push the plug body, the center head, and the nozzle plug to clamp the valve, the overall width of the head, that is, the distance from the trigger member to the cover, is greater than the pump cylinder connected to the head to cause the appearance of the head and the cylinder to be T-shaped, which is not conducive to carrying or storage.

Thus, a need exists for a novel portable air pump to mitigate and/or obviate the above disadvantages.

SUMMARY

An objective of the present invention is to provide a portable air pump including an inflating unit and a connection unit. The inflating unit includes a cylinder and a joint portion arranged at an air outlet end thereof. The cylinder has a chamber capable of compressing air therein to generate high pressure air. The joint portion has an air outlet channel unidirectionally communicating with the chamber. The connection unit includes a body, a valve connecting assembly, and a valve seat. The body has an axial hole and a joint hole communicating with the axial hole. The joint hole is detachably connected with the joint portion to cause the joint hole selectively communicating with the air outlet channel. The valve connecting assembly is arranged through the axial hole and includes a first connecting hole adapted to attach with a Schrader valve, a second connecting hole adapted to attach with a. Presta valve, and a through hole communicating with the axial hole. Either one of the first and second connecting holes is detachably-connected with the joint portion to cause one of the first and second connecting holes selectively communicating with the air outlet channel. The valve seat is movably arranged in the through hole. The joint hole selectively communicates with the first and second connecting holes as the valve seat moves relative to the through hole. The valve seat has a first abutting portion facing the first connecting hole and a second abutting portion facing the second connecting hole. The first abutting portion is adapted to abut against a valve core of the Schrader valve, and the second abutting portion is adapted to abut a lock nut of the Presta valve to cause the valve seat moved relative to the through hole by being pushed by the Schrader valve or the Presta valve.

In an embodiment, the cylinder extends along a first axis. The body extends along a second axis. When the portable air pump is in a storage state, one of the first and second connecting holes is connected with the joint portion, and, the first axis is parallel or coincident with the second axis. When the portable air pump is in a use state, the joint hole is connected with the joint portion, and the first axis is perpendicular to the second axis.

In an embodiment, the cylinder has a first outer diameter along a radial direction of the first axis. The body has a second outer diameter along a radial direction of the second axis. The first outer diameter and the second outer diameter are coaxial with each other.

In an embodiment, the joint portion has an outer thread formed around an outer periphery thereof. The joint hole has a first inner thread formed around an inner periphery thereof and corresponding to the outer thread to screw each other. The first connecting hole has a second inner thread formed around an inner periphery thereof and corresponding to the outer thread to screw each other.

In another embodiment, the joint portion has an outer thread formed around an outer periphery thereof. The joint hole has a first inner thread formed around an inner periphery thereof and corresponding to the outer thread to screw each other. The second connecting hole has a second inner thread formed around an inner periphery thereof and corresponding to the outer thread to screw each other.

In an embodiment, the valve connecting assembly includes a first connecting member and a second connecting member inserting through the axial hole and connected with the first connecting member. The first connecting hole is arranged on the first connecting member. The second connecting hole and the through hole are arranged on the second connecting member. The valve connecting assembly has an air passage formed between an inner periphery of the axial hole and an outer periphery of the second connecting member and communicating with the joint hole. The second connecting member has an air hole penetrating therethrough and communicating with the air passage and the through hole. The valve seat is provided with an airtight ring arranged on an outer periphery thereof and abutting against an inner periphery of the through hole. When the second abutting portion of the valve seat is pushed by the Presta valve to move the valve seat relative to the through hole and approach the first connecting hole, the airtight ring is located between the air hole and the first connecting hole, and the air hole communicates with the second connecting hole. When the first abutting portion of the valve seat is pushed by the Schrader valve to move the valve seat relative to the through hole and approach the second connecting hole, the airtight ring passes over the air hole and is located between the air hole and the second connecting hole, and the air hole communicates with the first connecting hole.

In an embodiment, the connection unit forms a length from a terminal end of the first connecting member to a terminal end of the second connecting member along the radial direction of the second axis. The length is greater than the second outer diameter.

In an embodiment, the inflating unit includes an air pipe. One end of the air pipe is provided with the joint portion and another end of the air pipe has a piston arranged in the chamber and a one-way valve disposed between the chamber and the air outlet channel. The cylinder is movable relative to the air pipe to cause the piston to compress the air in the chamber to generate high pressure air which unidirectionally enters the air outlet channel from the chamber through the one-way valve.

In an embodiment, a spacer is detachably screwed to the joint portion of the air pipe. The spacer is located between the inflating unit and the connection unit.

In another embodiment, the inflating unit includes a joint member connected to one end of the cylinder, and a piston rod movably inserting through the chamber. One end of the joint member is provided with the joint portion and inside the joint member has a one-way valve located between the chamber and the air outlet channel. One end of the piston rod has a piston adapted to compress the air in the chamber to generate high pressure air and another end of the piston rod has a gripping portion for a user to grip.

The present invention will become clearer in light of the following detailed description of illustrative embodiments of this invention described in connection with the drawings.

DETAILED DESCRIPTION

Figure 1:
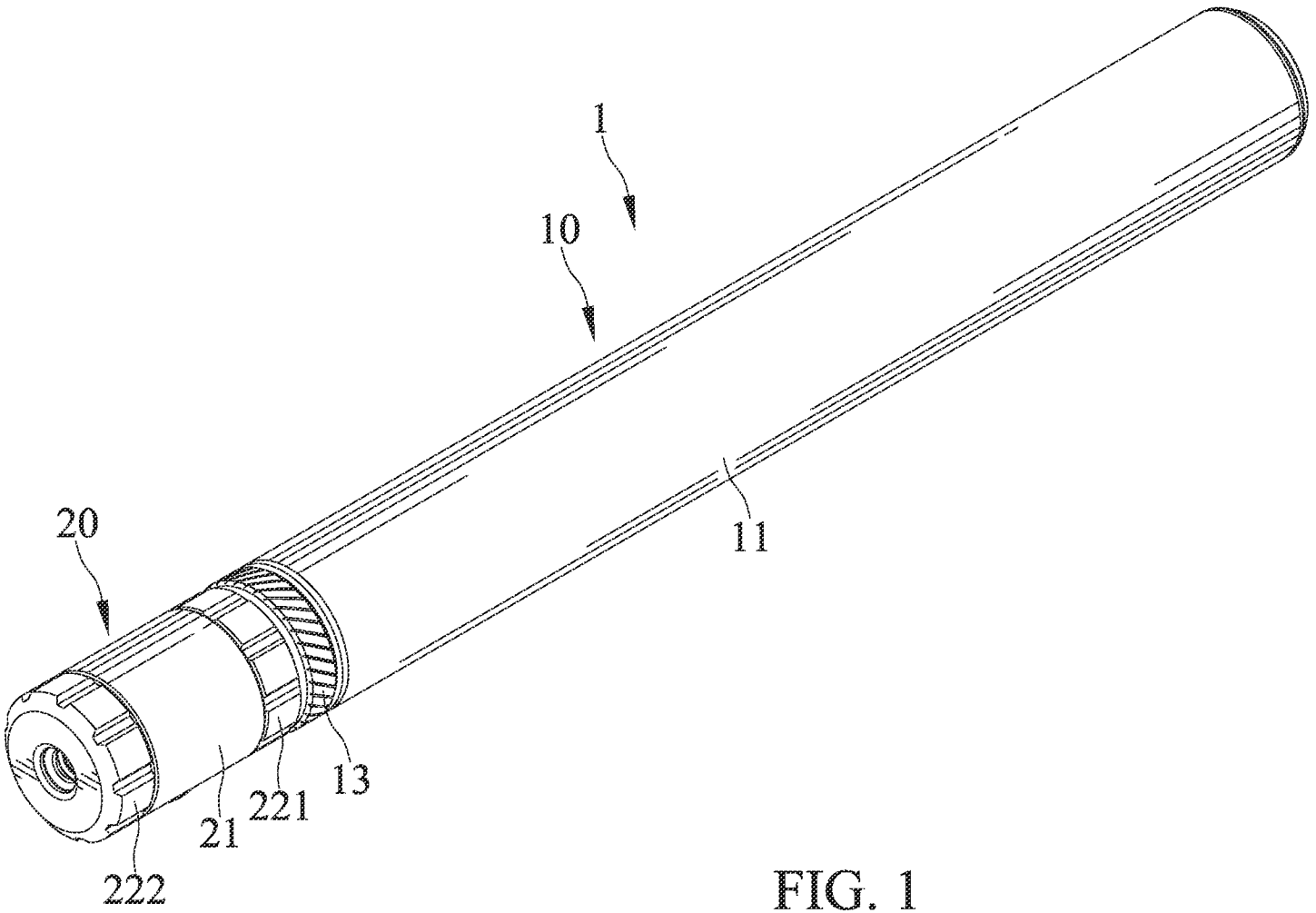
FIG. 1 is a perspective view of a portable air pump of a first embodiment according to the present invention and shows the portable air pump in a storage state.
Figure 2:
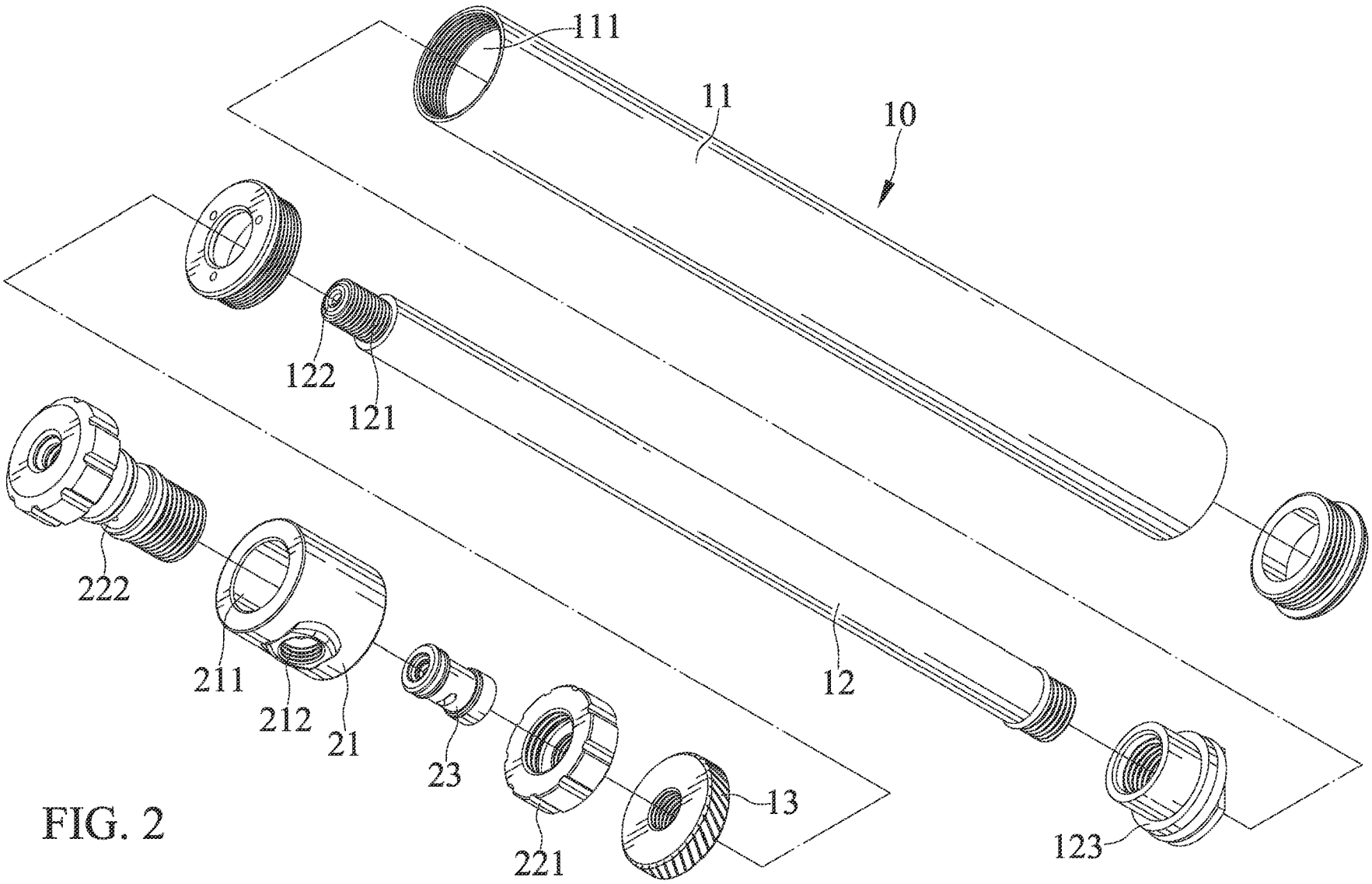
FIG. 2 is an exploded perspective view of the portable air pump of FIG. 1.
Figure 3:
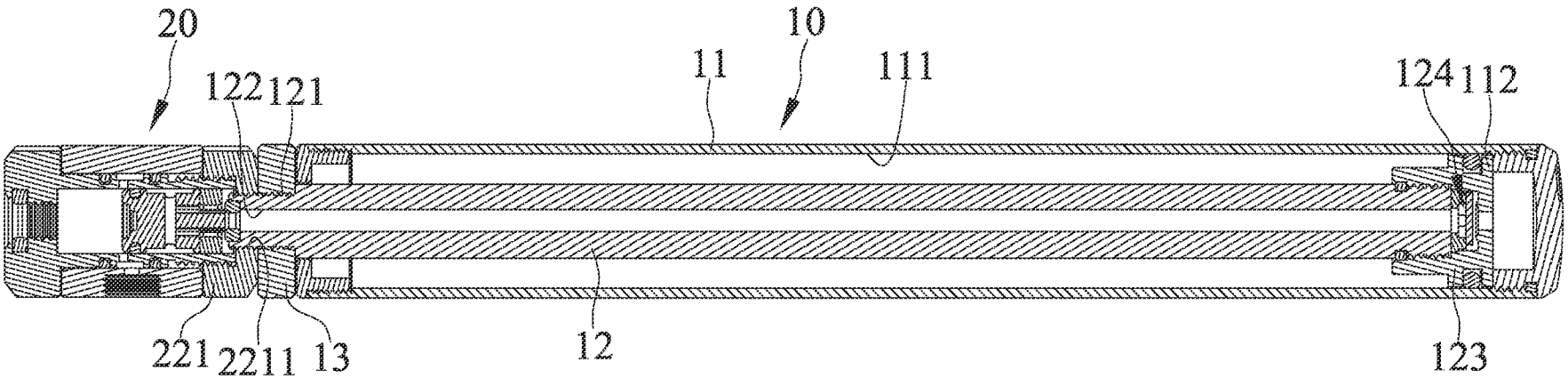
FIG. 3 is a cross sectional view of the portable air pump of FIG. 1.
Figure 4:
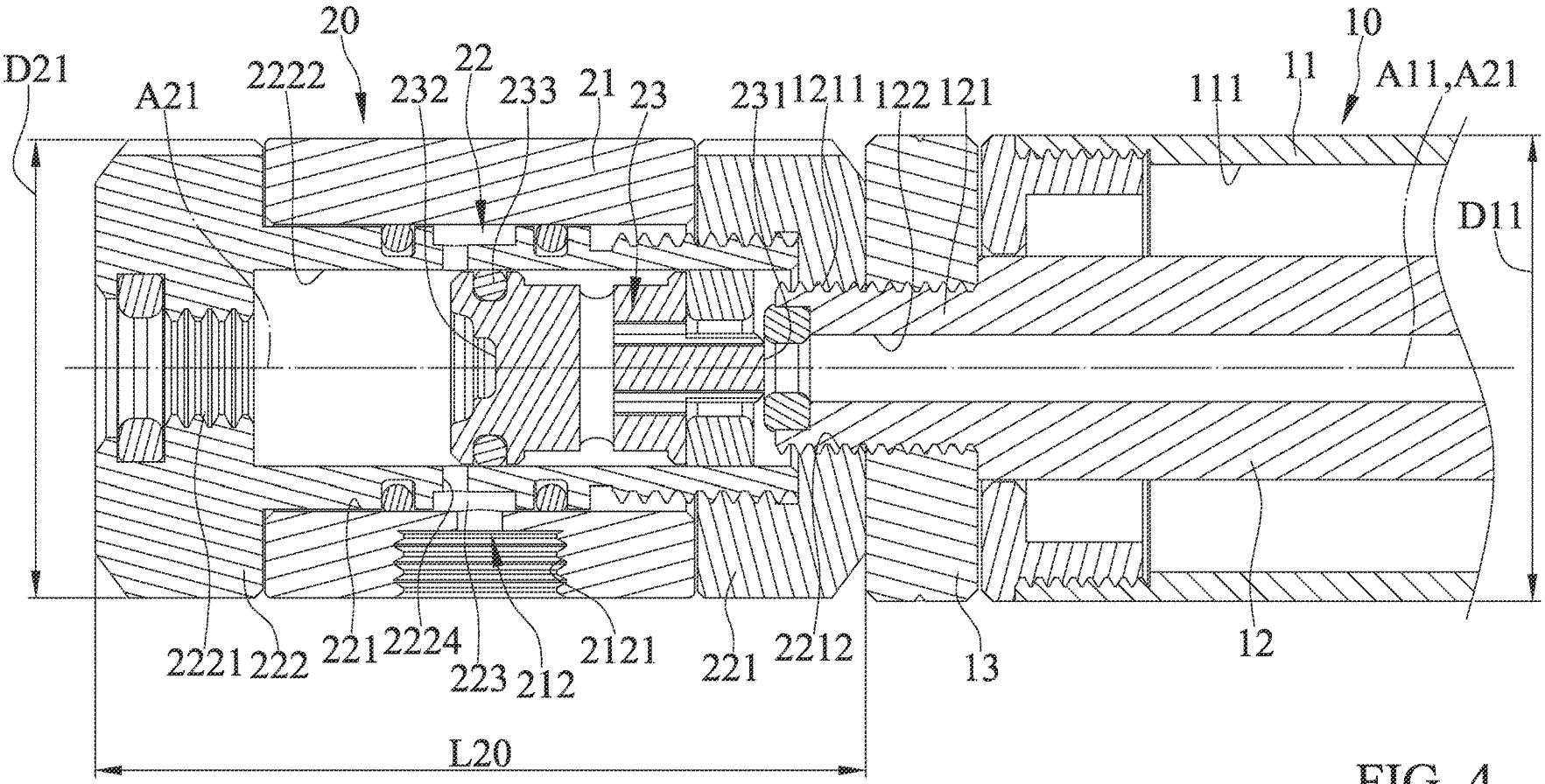
FIG. 4 is a partial enlarged view of FIG. 3.

FIGS. 1-5 show a portable air pump 1 of a first embodiment according to the present invention. The portable air pump 1 includes an inflating unit 10 and a connection unit 20. The inflating unit 10 includes a cylinder 11 and a joint portion 121 arranged at an air outlet end thereof and protruding out of the cylinder 11. The cylinder 11 has a chamber 111 capable of compressing air therein to generate high pressure air. The joint portion 121 has an air outlet channel 122 unidirectionally communicating with the chamber 111. The connection unit 20 includes a body 21, a valve connecting assembly 22, and a valve seat 23. The body 21 has an axial hole 211 and a joint hole 212 communicating with the axial hole 211. The joint hole 212 is detachably connected with the joint portion 121 to cause the joint hole 212 selectively communicating with the air outlet channel 122. The valve connecting assembly 22 is arranged through the axial hole 211 and includes a first connecting hole 2211 adapted to attach with a Schrader valve (not shown), a second connecting hole 2221 adapted to attach with a Presta valve (not shown), and a through hole 2222 communicating with the axial hole 211. The first connecting hole 2211 of the embodiment is to detachably connected with the joint portion 121 to cause the first connecting holes 2211 selectively communicating with the air outlet channel 122. The valve seat 23 is movably arranged in the through hole 2222. The joint hole 212 selectively communicates with the first and second connecting holes 2211 and 2221 as the valve seat 23 moves relative to the through hole 2222. The valve seat 23 has a first abutting portion 231 facing the first connecting hole 2211 and a second abutting portion 232 facing the second connecting hole 2221. The first abutting portion 231 is adapted to abut against a valve core of the Schrader valve, and the second abutting portion 232 is adapted to abut a lock nut of the Presta valve to cause the valve seat 23 moved relative to the through hole 2222 by being pushed by the Schrader valve or the Presta valve.

Thus, the joint hole 212 of the body 21 and the first connecting hole 2211 of the valve connecting assembly 22 are detachably connected to the joint portion 121 so that a user can choose to connect the joint portion 121 with the joint hole 212 or the first connecting hole 2211 to change the appearance of the portable air pump 1, so as to facilitate carrying or storage, the present invention will be further described in detail below.

Figure 5:
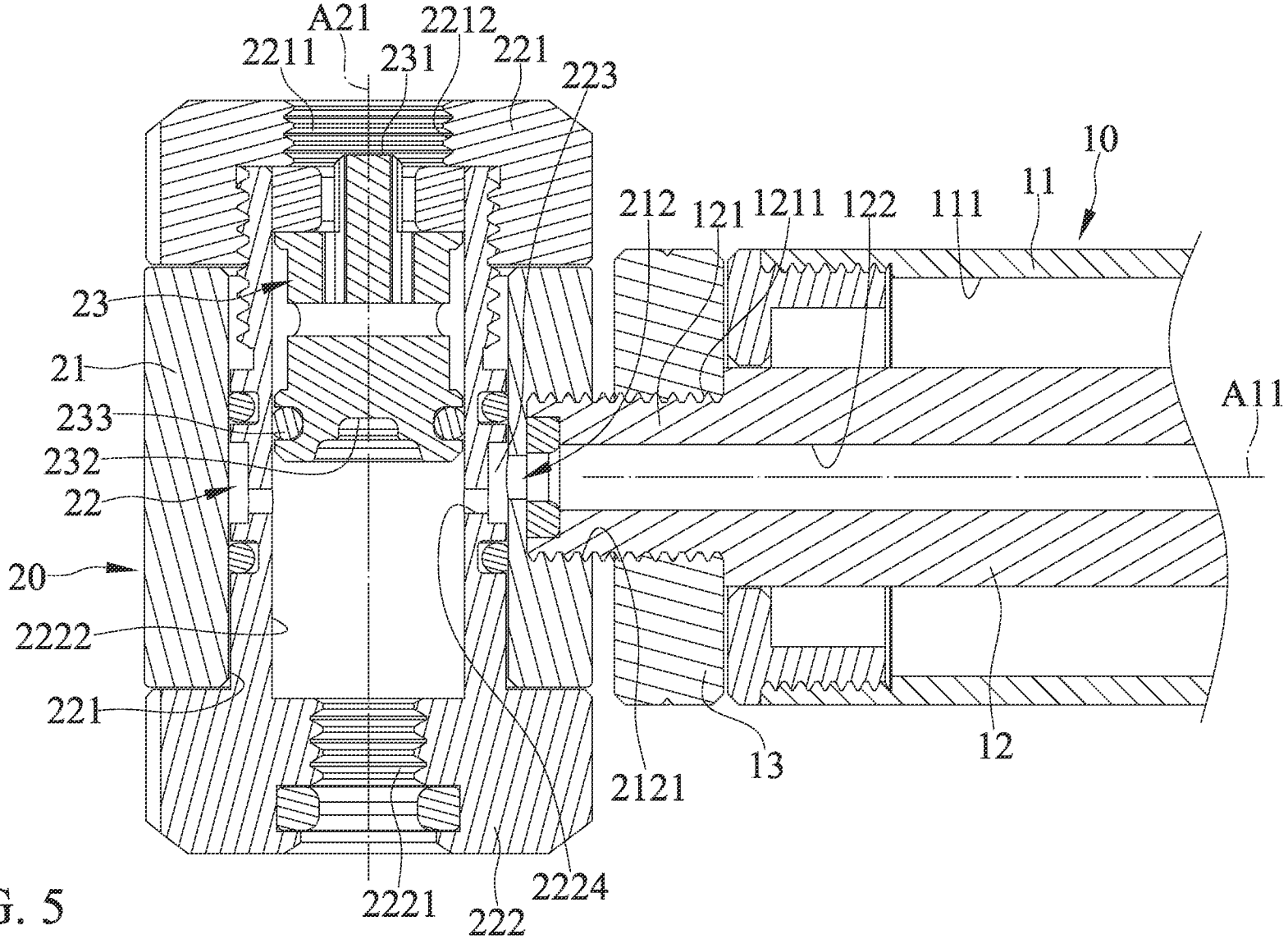
FIG. 5 is a continued view of FIG. 3 and shows the portable air pump transitioned from the storage state to the use state.

The cylinder 11 extends along a first axis A11, and the body 21 extends along a second axis A21. The portable air pump 1 can be transformed between a storage state (FIG. 4) and a use state (FIG. 5). When the portable air pump 1 is in the storage state, the first connecting holes is connected with the joint portion 121, the first axis A11 is parallel or coincident with the second axis A21 so that the appearance of the portable air pump 1 is formed in an I-shape to facilitate carrying or storage. When the portable air pump 1 is in the use state, the joint hole 212 is connected with the joint portion 121, the first axis A11 is perpendicular to the second axis A21 so that the appearance of the portable air pump 1 is formed in a T-shape, the high pressure air generated from the chamber 111 can unidirectionally pass through the air outlet channel 122 and enter the first connecting hole 2211 or the second connecting hole 2221, so as to inflate the Schrader valve attached with the first connecting hole 2211 or the Presta valve attached with the second connecting hole 2221. There is no need to assemble the components separately or change the orientation of the components.

Further, the cylinder 11 has a first outer diameter D11 along a radial direction of the first axis A11, and the body 21 has a second outer diameter D21 along a radial direction of the second axis A21. The first outer diameter D11 and the second outer diameter D21 are coaxial with each other.

Therefore, when the portable air pump 1 is in the storage state, the cylinder 11 and the body 21 are substantially flush with each other, so that the portable air pump 1 has a more compact appearance and is easy to carry or store.

The joint portion 121 has an outer thread 1211 formed around an outer periphery thereof. The joint hole 212 has a first inner thread 2121 formed around an inner periphery thereof and corresponding to the outer thread 1211 to screw each other, and the first connecting hole 2211 has a second inner thread 2212 finned around an inner periphery thereof and corresponding to the outer thread 1211 to screw each other. Thus, the joint hole 212 and the first connecting hole 2211 can be detachably connected to the joint portion 121.

The valve connecting assembly 22 includes a first connecting member 221 and a second connecting member 222 inserting through the axial hole 211 and connected with the first connecting member 221. The first connecting hole 2211 is arranged on the first connecting member 221, and the second connecting hole 2221 and the through hole 2222 are arranged on the second connecting member 222. The valve connecting assembly 22 has an air passage 223 formed between an inner periphery of the axial hole 211 and an outer periphery of the second connecting member 222 and communicating with the joint hole 212. The second connecting member 222 has an air hole 2224 penetrating therethrough and communicating with the air passage 223 and the through hole 2222. The valve seat 23 is provided with an airtight ring 233 arranged on an outer periphery thereof and abutting against an inner periphery of the through hole 2222. When the second abutting portion 232 of the valve seat 23 is pushed by the Presta valve to move the valve seat 23 relative to the through hole 2222 and approach the first connecting hole 2211, the airtight ring 233 is located between the air hole 2224 and the first connecting hole 2211, and the air hole 2224 communicates with the second connecting hole 2221. When the first abutting portion 231 of the valve seat 23 is pushed by the Schrader valve to move the valve seat 23 relative to the through hole 2222 and approach the second connecting hole 2221, the airtight ring 233 passes over the air hole 2224 and is located between the air hole 2224 and the second connecting hole 2221, and the air hole 2224 communicates with the first connecting hole 2211.

Furthermore, the connection unit 20 forms a length L20 from a terminal end of the first connecting member 2211 to a terminal end of the second connecting member 222 along the radial direction of the second axis A21, and the length L20 is greater than the second outer diameter D21. Thus, the appearance of the portable air pump 1 is formed in a T-shape when the portable air pump 1 is in the use state.

The inflating unit 10 of the embodiment includes an air pipe 12. One end of the air pipe 12 is provided with the joint portion 121 and another end of the air pipe 12 has a piston 123 arranged in the chamber 111 and a one-way valve 124 disposed between the chamber 111 and the air outlet channel 122. The cylinder 11 is movable relative to the air pipe 12 to cause the piston 123 to compress the air in the chamber 111 to generate high pressure air which unidirectionally enters the air outlet channel 122 from the chamber 111 through the one-way valve 124. In addition, a spacer 13 is detachably screwed to the joint portion 12:1 of the air pipe 12, and the spacer 13 is located between the inflating unit 10 and the connection unit.

Figure 6:
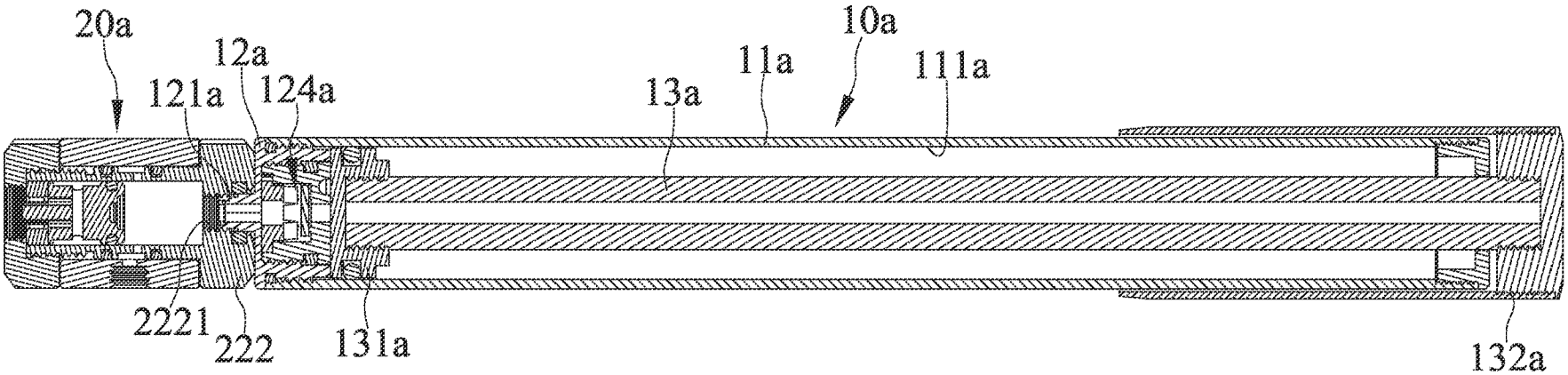
FIG. 6 is a cross sectional view of a portable air pump of a second embodiment according to the present invention and shows the portable air pump in a storage state.
Figure 7:
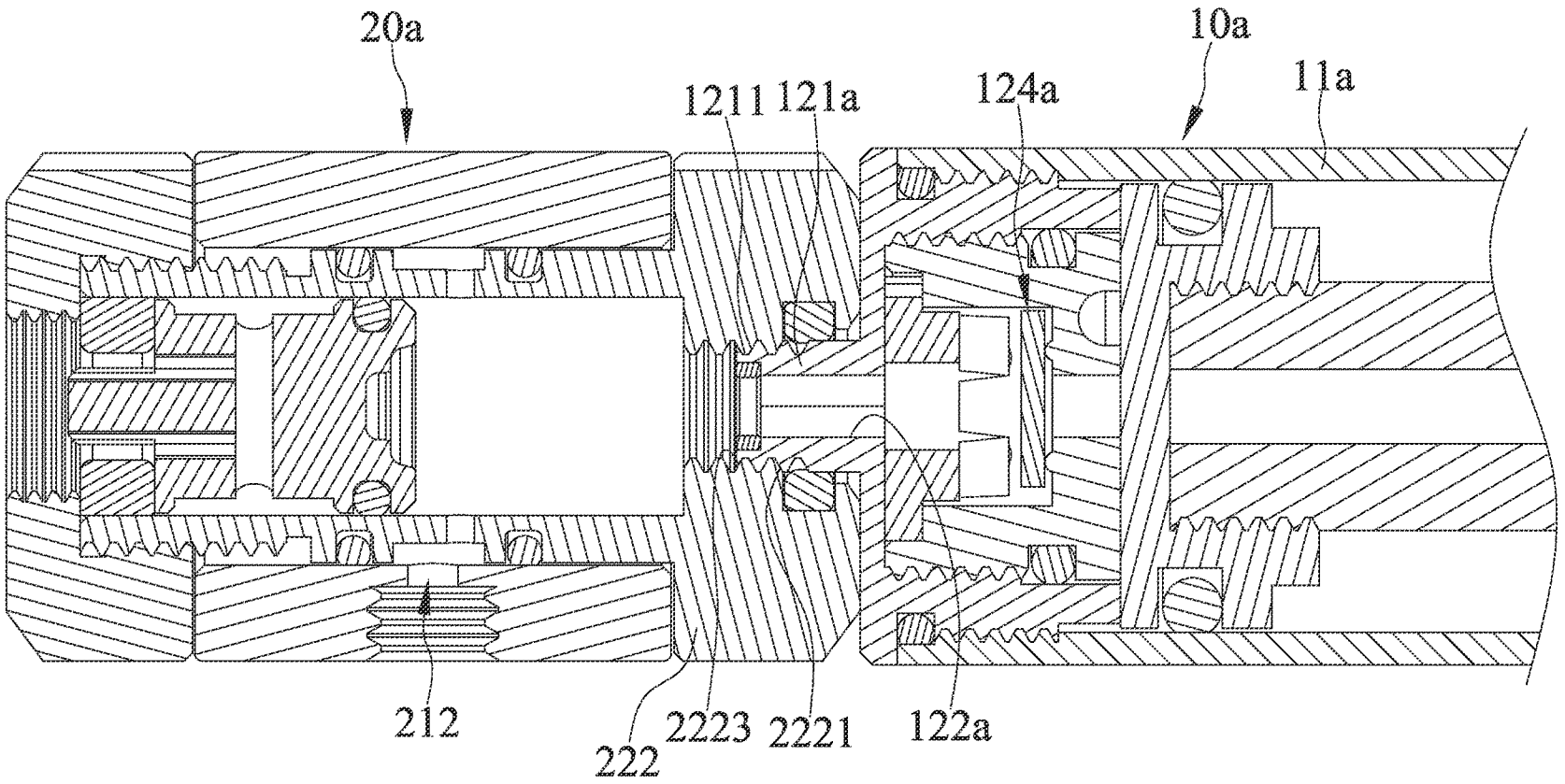
FIG. 7 is a partial enlarged view of FIG. 6.
Figure 8:
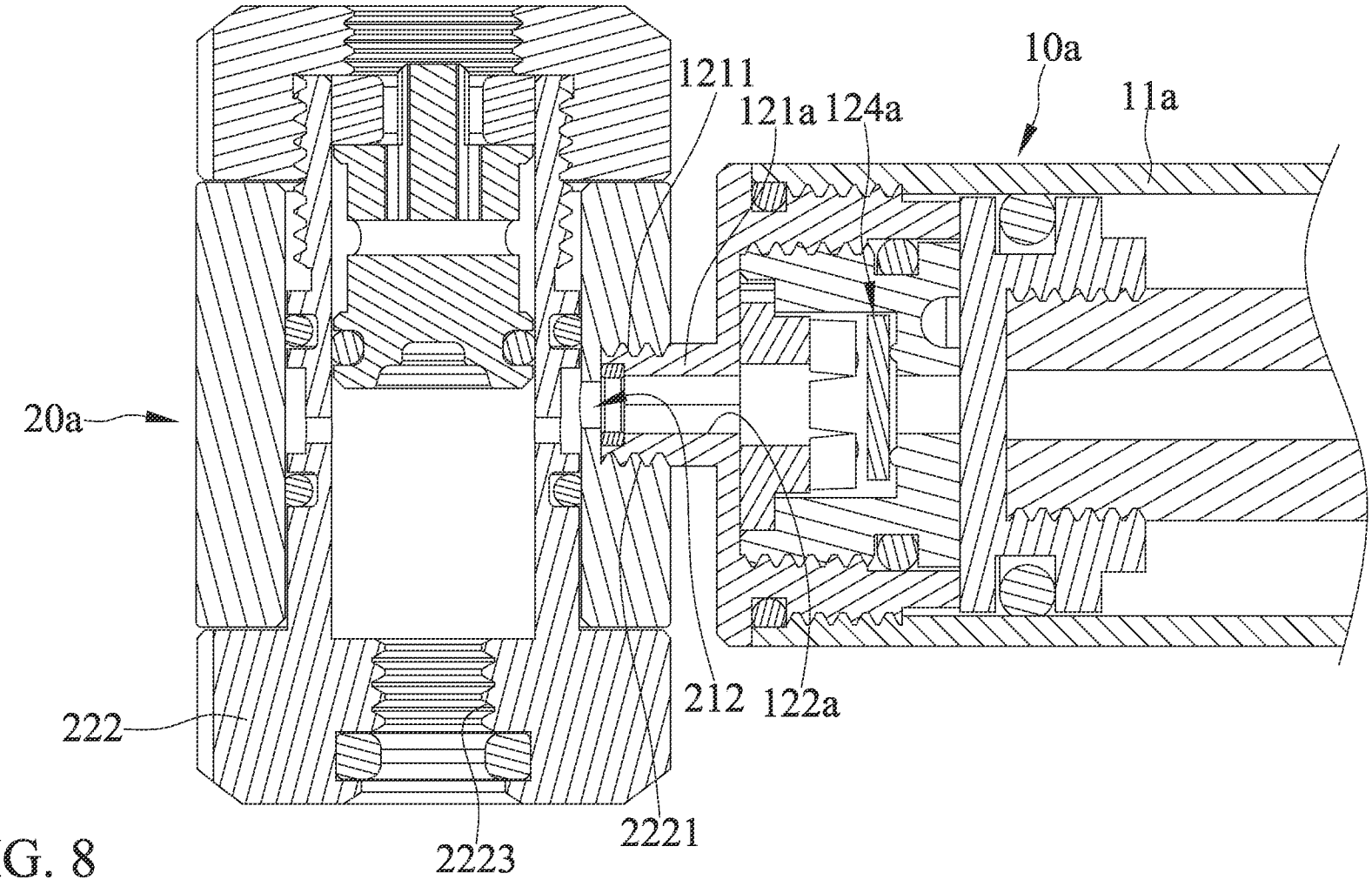
FIG. 8 is a continued view of FIG. 7 and shows the portable air pump transitioned from the storage state to the use state.

FIGS. 6-8 show a portable air pump 1*a* of a second embodiment according to the present invention. The second embedment is substantially the same as the first embodiment. The main differences are that the second connecting hole 2221 of the second connecting member 222 has a second inner thread 2223 formed around an inner periphery thereof and corresponding to the outer thread 1211 of the joint portion 121*a* to screw each other. The portable air pump 1*a* can be transformed between a storage state (FIG. 7) and a use state (FIG. 8). When the portable air pump 1*a* is in the storage state, the second connecting holes 2221 is connected with the joint portion 121. When the portable air pump 1*a* is in the use state, the joint hole 212 is connected with the joint portion 121*a*. Further, the inflating unit 10*a* includes a joint member 12*a* connected to one end of the cylinder 11*a*, and a piston rod 13*a* movably inserting through the chamber 111*a*. One end of the joint member 12*a* is provided with the joint portion 121*a* and inside the joint member 12*a* has a one-way valve 124*a* located between the chamber 111*a* and the air outlet channel 122*a*. One end of the piston rod 13*a* has a piston 131*a* adapted to compress the air in the chamber 111*a* to generate high pressure air and another end of the piston rod 13*a* has a gripping portion 132*a* for a user to grip.

Although specific embodiments have been illustrated and described, numerous modifications and variations are still possible without departing from the scope of the invention. The scope of the invention is limited by the accompanying claims.

The invention claimed is:

1. A portable air pump comprising:

an inflating unit including a cylinder and a joint portion arranged at an air outlet end thereof wherein the cylinder has a chamber capable of compressing air therein to generate high pressure air, and wherein the joint portion has an air outlet channel unidirectionally communicating with the chamber; and a connection unit including a body, a valve connecting assembly, and a valve seat, wherein the body has an axial hole and a joint hole communicating with the axial hole, wherein the joint hole is detachably connected with the joint portion to cause the joint hole to selectively communicate with the air outlet channel, wherein the valve connecting assembly is arranged through the axial hole and includes a first connecting hole adapted to attach with a Schrader valve, a second connecting hole adapted to attach with a Presta valve, and a through hole communicating with the axial hole, wherein either one of the first and second connecting holes is detachably connected with the joint portion to cause one of the first and second connecting holes to selectively communicate with the air outlet channel, wherein the valve seat is movably arranged in the through hole, wherein the joint hole selectively communicates with the first and second connecting holes as the valve seat moves relative to the through hole, wherein the valve seat has a first abutting portion facing the first connecting hole and a second abutting portion facing the second connecting hole, wherein the first abutting portion is adapted to abut against a valve core of the Schrader valve, and the second abutting portion is adapted to abut a lock nut of the Presta valve to cause the valve seat to be moved relative to the through hole by being pushed by the Schrader valve or the Presta valve.

2. The portable air pump as claimed in claim 1, wherein the cylinder extends along a first axis, wherein the body extends along a second axis; wherein when the portable air pump is in a storage state, one of the first and second connecting holes is connected with the joint portion, and the first axis is parallel or coincident with the second axis; wherein when the portable air pump is in a use state, the joint hole is connected with the joint portion, and the first axis is perpendicular to the second axis.

3. The portable air pump as claimed in claim 2, wherein the cylinder has a first outer diameter along a radial direction of the first axis, wherein the body has a second outer diameter along a radial direction of the second axis, and wherein the first outer diameter and the second outer diameter are coaxial with each other when the portable air pump is in the storage state.

4. The portable air pump as claimed in claim 3, wherein the joint portion has an outer thread formed around an outer periphery thereof, wherein the joint hole has a first inner thread formed around an inner periphery thereof and corresponding to the outer thread such that they may be threadedly engaged, and wherein the first connecting hole has a second inner thread formed around an inner periphery thereof and corresponding to the outer thread such that they may be threadedly engaged.

5. The portable air pump as claimed in claim 3, wherein the joint portion has an outer thread formed around an outer periphery thereof, wherein the joint hole has a first inner thread formed around an inner periphery thereof and corresponding to the outer thread such that they may be threadedly engaged, and wherein the second connecting hole has a second inner thread formed around an inner periphery thereof and corresponding to the outer such that they may be threadedly engaged.

6. The portable air pump as claimed in claim 3, wherein the valve connecting assembly includes a first connecting member and a second connecting member inserting inserted through the axial hole and connected with the first connecting member, wherein the first connecting hole is arranged on the first connecting member, wherein the second connecting hole and the through hole are arranged on the second connecting member, wherein the valve connecting assembly has an air passage formed between an inner periphery of the axial hole and an outer periphery of the second connecting member and communicating with the joint hole, wherein the second connecting member has an air hole penetrating therethrough and communicating with the air passage and the through hole, and wherein the valve seat is provided with an airtight ring arranged on an outer periphery thereof and abutting against an inner periphery of the through hole;

wherein when the second abutting portion of the valve seat is pushed by the Presta valve to move the valve seat relative to the through hole and approach the first connecting hole, the airtight ring is located between the air hole and the first connecting hole, and the air hole communicates with the second connecting hole;

wherein when the first abutting portion of the valve seat is pushed by the Schrader valve to move the valve seat relative to the through hole and approach the second connecting hole, the airtight ring passes over the air hole and is located between the air hole and the second connecting hole, and the air hole communicates with the first connecting hole.

7. The portable air pump as claimed in claim 6, wherein the connection unit forms a length, along the second axis, from a terminal end of the first connecting member to a terminal end of the second connecting member, and wherein the length is greater than the second outer diameter.

8. The portable air pump as claimed in claim 4, wherein the inflating unit includes an air pipe, wherein one end of the air pipe is provided with the joint portion and another end of the air pipe has a piston arranged in the chamber and a one-way valve disposed between the chamber and the air outlet channel, and wherein the cylinder is movable relative to the air pipe to cause the piston to compress the air in the chamber to generate high pressure air which unidirectionally enters the air outlet channel from the chamber through the one-way valve.

9. The portable air pump as claimed in claim 8, wherein a spacer is detachably screwed to the joint portion of the air pipe, and wherein the spacer is located between the inflating unit and the connection unit.

10. The portable air pump as claimed in claim 5, wherein the inflating unit includes a joint member connected to one end of the cylinder, and a piston rod movably inserting through inserted in the chamber, wherein one end of the joint member is provided with the joint portion and inside the joint member has a one-way valve located between the chamber and the air outlet channel, and wherein one end of the piston rod has a piston adapted to compress the air in the chamber to generate high pressure air and another end of the piston rod has a gripping portion for a user to grip.

* * * * *